US006893306B2

(12) United States Patent
Shibata et al.

(10) Patent No.: US 6,893,306 B2
(45) Date of Patent: May 17, 2005

(54) COOLING ARRANGEMENT FOR OUTBOARD MOTOR

(75) Inventors: Yasuhiko Shibata, Shizuoka (JP); Manabu Nakayama, Shizuoka (JP); Yukio Takeda, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 200 days.

(21) Appl. No.: 10/106,525

(22) Filed: Mar. 25, 2002

(65) Prior Publication Data

US 2002/0146946 A1 Oct. 10, 2002

(30) Foreign Application Priority Data

Apr. 9, 2001 (JP) ..... 2001-109807

(51) Int. Cl.[7] ..... B63H 21/10
(52) U.S. Cl. ..... 440/88 G
(58) Field of Search ..... 440/88 R, 88 C, 440/88 D, 88 G, 88 J, 88 K, 89 R, 89 B, 89 C, 89 D

(56) References Cited

U.S. PATENT DOCUMENTS 4,350,010 A 9/1982 Yukishima
5,118,316 A 6/1992 Kakizaki et al.
5,232,387 A 8/1993 Sumigawa
5,462,464 A 10/1995 Ming
5,595,515 A 1/1997 Hasegawa et al.
5,733,157 A 3/1998 Okuzawa et al.
5,769,038 A 6/1998 Takahashi et al.
5,937,801 A * 8/1999 Davis ..... 123/41.33
6,027,385 A 2/2000 Katayama et al.
6,074,258 A * 6/2000 Arai et al. ..... 440/77

FOREIGN PATENT DOCUMENTS

JP 8-230783 9/1996
JP 10-324295 12/1998

* cited by examiner

*Primary Examiner*—Jesus D. Sotelo
(74) *Attorney, Agent, or Firm*—Knobbe, Martens, Olson & Bear, LLP

(57) ABSTRACT

An outboard motor includes an engine and a housing unit mounted on an associated watercraft. An intermediate unit is coupled with the housing unit to support the engine above the housing unit. An exhaust conduit discharging exhaust gases from the engine depends from the intermediate unit to extend generally vertically within the housing unit. The intermediate unit defines a coolant passage having a discharge port spaced apart from an outer surface of the exhaust conduit. A guide member is arranged to guide the coolant discharged from the discharge port toward the outer surface of the exhaust conduit.

22 Claims, 10 Drawing Sheets

COOLING ARRANGEMENT FOR OUTBOARD MOTOR

PRIORITY INFORMATION

This application is based on and claims priority to Japanese Patent Application No. 2001-109807, filed Apr. 9, 2001, the entire contents of which is hereby expressly incorporated by reference.

BACKGROUND OF THE INVENTION

1. Field of the Invention

This invention relates generally to a cooling arrangement for an outboard motor, and more particularly to an improved cooling arrangement for an exhaust conduit of an outboard motor.

2. Description of Related Art

An outboard motor typically comprises a housing unit that can be mounted on an associated watercraft. An internal combustion engine is disposed above the housing unit. Typically, the outboard motor employs an exhaust system that includes an exhaust conduit extending generally vertically within the housing unit to discharge exhaust gases from the engine. Because the exhaust gases bear considerable heat, heat is continually transferred to the exhaust conduit during operation of the engine. Cooling the exhaust conduit as well as the engine thus is necessary.

Conventional outboard motors typically employ open-loop cooling systems that draw cooling water from a body of water in which the outboard motor is operated (e.g., a lake or an ocean) primarily to cool the engine. The cooling water also is available for cooling the exhaust conduit and exhaust gases passing therethrough. In some of these systems, the cooling water that has traveled around water jackets in the engine is used for cooling the exhaust system. In other systems, part of fresh water ascending to the engine is delivered to the exhaust conduit.

For example, U. S. Pat. No. 6,027,385 discloses an engine supported by an exhaust guide member that defines a vertically extending exhaust passage communicating with one or more exhaust ports in the engine. A lubricant reservoir depends from the exhaust guide member to store lubricant oil. The lubricant reservoir is affixed to the bottom of the exhaust guide member and forms a central hollow portion. An exhaust conduit is affixed to a portion of the lubricant reservoir and extends through the central hollow portion. The exhaust conduit communicates with the exhaust passage of the exhaust guide member. This patent also discloses a water passage extending through the exhaust guide member and the portion of the lubricant reservoir (FIG. 17). The water passage defines a discharge port underneath the reservoir. The discharge port opens to the central hollow portion. Accordingly, at least part of cooling water can be discharged at a location close to the exhaust conduit.

Japanese Laid Open Publication No. 8-230783 discloses an outboard motor having a water supply pipe that supplies fresh water to the engine. The water supply pipe extends in parallel to the exhaust conduit and defines a small hole facing to the exhaust conduit. Part of the fresh water thus impinges onto an outer surface of the exhaust conduit. In this arrangement, a certain limited area of the exhaust conduit can be cooled. However, a major part of the conduit, particularly an area on an opposite side of the exhaust conduit, is not cooled by the water.

SUMMARY OF THE INVENTION

A need therefore exists for an improved cooling arrangement for an outboard motor with improved cooling of an exhaust conduit extending generally vertically within its housing unit.

In accordance with one aspect of the present invention, an outboard motor includes a housing unit adapted to be mounted on an associated watercraft. The outboard motor also includes an internal combustion engine having at least one exhaust port. An engine support supports the engine above the housing unit. An exhaust system is configured to guide exhaust gasses from the exhaust port. The exhaust system includes an exhaust manifold communicating with the exhaust port and an exhaust conduit having an upper end communicating with the exhaust manifold and extending downwardly into the housing. A cooling system is configured to guide coolant into thermal communication with at least a portion of the exhaust system. The cooling system includes a coolant conduit extending along a first direction generally parallel to the exhaust conduit and terminating at a first discharge opening disposed adjacent to the exhaust conduit. Additionally, a guide member is disposed adjacent to the first discharge opening. The guide member has a surface at least partially overlapping the first discharge opening and skewed relative to the first direction such that coolant discharged from the first discharge opening is diverted by the surface toward the exhaust conduit.

In accordance with another aspect of the present invention, an outboard motor includes a housing unit adapted to be mounted on an associated watercraft and an internal combustion engine. A support member is coupled with the housing unit and supports the engine above the housing unit. An exhaust conduit is arranged to discharge exhaust gases from the engine. A spacer is coupled with the support member to carry the exhaust conduit under the engine so that the exhaust conduit extends generally vertically within the housing unit. At least the spacer defines a coolant passage having a discharge port spaced apart from an outer surface of the exhaust conduit. Additionally, a guide is configured to direct coolant discharged from the discharge port toward the outer surface of the exhaust conduit.

In accordance with a further aspect of the present invention, an outboard motor comprises an internal combustion engine. A housing unit is disposed below the engine. An exhaust conduit is arranged to discharge exhaust gases from the engine. The exhaust conduit extends generally vertically within the housing unit. A cooling system is arranged to cool the exhaust conduit with coolant. The cooling system includes a coolant passage generally disposed higher than the exhaust conduit. The coolant passage defines a discharge port spaced apart from an outer surface of the exhaust conduit. Means are provided for guiding the coolant discharged from the discharge port so that the coolant swirls down around the exhaust conduit.

BRIEF DESCRIPTION OF THE DRAWINGS

These and other features, aspects and advantages of the present invention will now be described with reference to the drawings of a preferred embodiment, which is intended to illustrate and not to limit the invention. The drawings comprise ten figures.

DETAILED DESCRIPTION OF THE PREFERRED EMBODIMENT OF THE INVENTION

Figure 1:
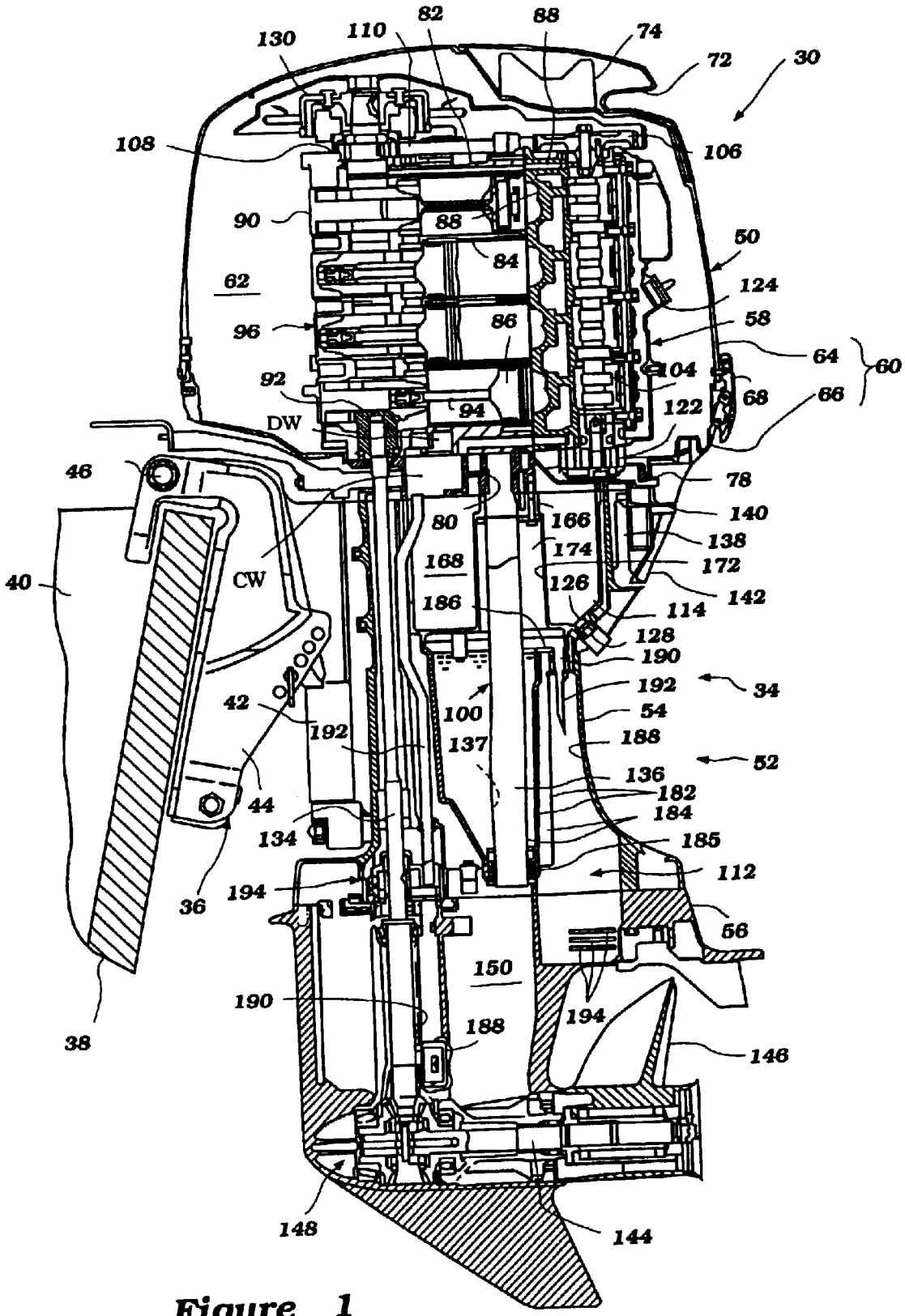
FIG. 1 is a side elevational and partial sectional view of an outboard motor having a driveshaft housing and configured in accordance with a preferred embodiment of the present invention.
Figure 2:
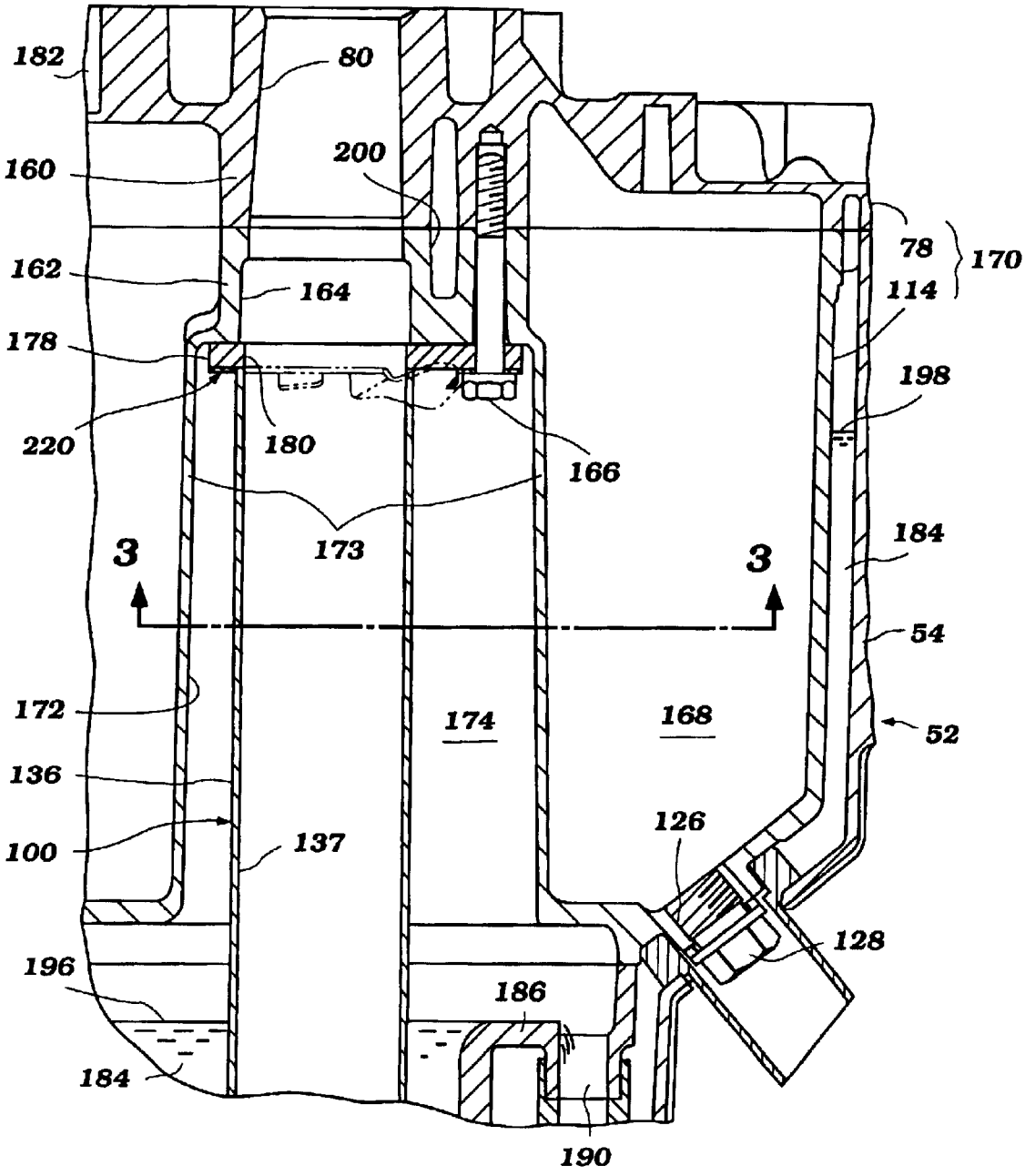
FIG. 2 is an enlarged side sectional view of the outboard motor showing an upper part of the driveshaft housing.

With reference to FIGS. 1 and 2, an overall construction of an outboard motor 30 configured in accordance with certain features, aspects and advantages of the present invention will be described.

In the illustrated arrangement, the outboard motor 30 comprises a drive unit 34 and a bracket assembly 36. The bracket assembly 36 supports the drive unit 34 on a transom 38 of an associated watercraft 40 and so as to place a marine propulsion device in a submerged position with the watercraft 40 resting on the surface of a body of water. The bracket assembly 36 preferably comprises a swivel bracket 42, a clamping bracket 44, a steering shaft and a pivot pin 46.

The steering shaft typically extends through the swivel bracket 42 and is affixed to the drive unit 34 with upper and lower mount assemblies. The steering shaft is pivotally journaled for steering movement about a generally vertically extending steering axis defined within the swivel bracket 42. The clamping bracket 44 comprises a pair of bracket arms that are spaced apart from each other and that are affixed to the watercraft transom 38. The pivot pin 46 completes a hinge coupling between the swivel bracket 42 and the clamping bracket 44. The pivot pin 46 extends through the bracket arms so that the clamping bracket 44 supports the swivel bracket 42 for pivotal movement about a generally horizontally extending tilt axis defined by the pivot pin 46. The drive unit 34 thus can be tilted or trimmed about the pivot pin 46.

As used through this description, the terms "forward," "forwardly" and "front" mean at or to the side where the bracket assembly 36 is located, and the terms "rear," "reverse," "backwardly" and "rearwardly" mean at or to the opposite side of the front side, unless indicated otherwise or otherwise readily apparent from the context of use.

A hydraulic tilt and trim adjustment system preferably is provided between the swivel bracket 42 and the clamping bracket 44 to tilt (raise or lower) the swivel bracket 42 and the drive unit 34 relative to the clamping bracket 44. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 50 and a housing unit 52 which includes a driveshaft housing 54 and a lower unit 56. The power head 50 is disposed atop the drive unit 34 and houses an internal combustion engine 58 that is positioned within a protective cowling 60.

Preferably, the protective cowling 60 defines a generally closed cavity 62 in which the engine 58 is disposed. In addition, the protective cowling 60 preferably comprises a top cowling member 64 and a bottom cowling member 66. The top cowling member 64 preferably is detachably affixed to the bottom cowling member 66 by a coupling mechanism 68 so that a user, operator, mechanic or repairperson can access the engine 58 for maintenance or for other purposes.

The top cowling 64 preferably has at least one air intake opening 72 and at least one air duct 74 disposed on its rear and top portion. Ambient air is drawn into the closed cavity 62 through the opening 72 and then through the duct 74. Typically, the top cowling member 64 tapers in girth toward its top surface, which is in the general proximity of the air intake opening 72.

The bottom cowling member 66 preferably has an opening at its bottom portion through which an upper portion of an exhaust guide member 78 extends. The exhaust guide member 78 preferably is made of an aluminum based alloy and is affixed atop the driveshaft housing 54. In other words, the exhaust guide member 78 is mounted on the driveshaft housing 54.

The bottom cowling member 66 and the exhaust guide member 78 together generally form a tray. The engine 58 is placed onto this tray and is affixed to the exhaust guide member 78. In other words, the exhaust guide member 78 supports the engine 58. The exhaust guide member 78 also defines an exhaust passage 80 through which burnt charges (e.g., exhaust gases) from the engine 58 are discharged, described in greater detail below. The exhaust passage 80 is generally configured as a square shape in section.

The engine 58 in the illustrated embodiment operates on a four-cycle combustion principle. The engine 58 has a cylinder block 82. The presently preferred cylinder block 82 defines four cylinder bores 84 which extend generally horizontally and are generally vertically spaced from one another. As used in this description, the term "horizontally" means that the subject portions, members or components extend generally in parallel to the water line where the associated watercraft 40 is resting when the drive unit 34 is not tilted and is placed in the position shown in FIG. 1. The term "vertically" in turn means that portions, members or components extend generally normal to those that extend horizontally. This type of engine, however, merely exemplifies one type of engine. Engines having other numbers of cylinders, having other cylinder arrangements, and operating on other combustion principles (e.g., crankcase compression two-stroke, diesel, or rotary) also can be employed.

A piston 86 reciprocates in each cylinder bore 84 in a well-known manner. A cylinder head assembly 88 is affixed to one end of the cylinder block 82 for closing the cylinder bores 84. The cylinder head assembly 88 preferably defines four combustion chambers 88 together with the associated pistons 86 and cylinder bores 84. Of course, the number of combustion chambers can vary, as indicated above. A crankcase assembly 90 closes the other end of the cylinder bores 84 and defines a crankcase chamber together with the cylinder block 82. A crankshaft 92 extends generally vertically through the crankcase chamber and is journaled for rotation by several bearing blocks in a suitable arrangement. Connecting rods 94 couple the crankshaft 92 in a well-known manner with the respective pistons 86. Thus, the crankshaft 92 can rotate with the reciprocal movement of the pistons 86.

Preferably, the crankcase assembly 90 is located at the most forward position, with the cylinder block 82 and the cylinder head member 86 extending rearward from the crankcase assembly 90, one after another. Generally, the cylinder block 82, the cylinder head member 86 and the crankcase assembly 90 together define an engine body 96. Preferably, at least these major engine portions 82, 86, 90 are made of aluminum based alloy. The aluminum alloy advantageously increases strength over cast iron while decreasing the weight of the engine body 96.

The engine 58 comprises an air induction system. The air induction system guides air to the combustion chambers 88 from the cavity 62 of the protective cowling assembly 60. The air induction system preferably comprises intake ports, four intake passages and a plenum chamber. The intake ports can be defined in the cylinder head assembly 88. In one configuration, intake valves (not shown) repeatedly open and close the respective intake ports. When each intake port is opened, the corresponding intake passage communicates with the associated combustion chamber 88.

The respective intake passages preferably have throttle valves (not shown) journaled therein for pivotal movement about an axis of a valve shaft that extends generally vertically. The throttle valves are operable by the operator through an appropriate conventional throttle valve linkage. The throttle valves meter or regulate an amount of air flowing through the respective air intake passages. Normally, the greater the opening degree, the higher the rate of airflow and the higher the engine speed.

The engine 58 also comprises an exhaust system 100 that guides burnt charges or exhaust gases to a location outside of the outboard motor 30. Each cylinder bore 84 preferably has exhaust ports defined in the cylinder head assembly 88. The exhaust ports are repeatedly opened and closed by exhaust valves (not shown).

An exhaust manifold (not shown) is defined next to the cylinder bores 84 in the cylinder block 82. The exhaust manifold preferably extends generally vertically. The exhaust manifold communicates with the exhaust ports to collect exhaust gases from the combustion chambers 88 through the respective exhaust ports. The exhaust manifold is generally configured with a square cross section and is coupled with the exhaust passage 80 of the exhaust guide member 78. When the exhaust ports are opened, the combustion chambers 88 communicate with this exhaust passage 80 through the exhaust manifold.

A valve cam mechanism preferably is provided for actuating the intake and exhaust valves. In the illustrated embodiment, the cylinder head assembly 88 rotatably journals a single or double camshaft arrangement 104, which extends generally vertically. The camshafts 104 actuate the intake valves and exhaust valves. The camshafts 104 have cam lobes to push the intake and exhaust valves in a controlled timing to open and close the intake and exhaust ports. Other conventional valve drive mechanisms can be employed instead of such a mechanism using one or more camshafts.

A camshaft drive mechanism is provided for driving the valve cam mechanism. The camshafts 104 have driven sprockets 106 positioned atop thereof and the crankshaft 92 has a drive sprocket 108 near a top thereof. A timing chain or belt 110 is wound around the drive and driven sprockets 108, 106. The crankshaft 92 thus drives the camshafts 104 with the timing chain 110. A diameter of the driven sprockets 106 preferably is twice as large as a diameter of the drive sprocket 106. The camshafts 104 thus rotate at half of the speed of the rotation of the crankshaft 92.

The engine 58 preferably has a port or manifold fuel injection system. The fuel injection system preferably comprises four fuel injectors with one fuel injector allotted for each of the respective combustion chambers 88. Each fuel injector preferably has an injection nozzle directed toward the associated intake passage adjacent to the intake ports. The fuel injector also preferably has a plunger that normally closes the nozzle and a solenoid coil that moves the plunger from the closed position to an open position when energized with electric power. The fuel injectors spray fuel into the intake passages under the control of an ECU (electronic control unit). The ECU controls energizing timing and duration of the solenoid coils so that the plungers open the nozzles to spray a proper amount of fuel into the engine 58 during each combustion cycle. Of course, in some arrangements, the fuel injectors can be disposed for direct cylinder injection and, in other arrangements, carburetors can replace or accompany the fuel injectors.

The engine 58 further comprises an ignition or firing system. Each combustion chamber 88 is provided with a spark plug connected to the ECU so that ignition timing can be controlled by the ECU. The spark plugs have electrodes that are exposed into the associated combustion chamber and that ignite an air/fuel charge in the combustion chamber at selected ignition timings. The ignition system preferably has an ignition coil and an igniter.

The ignition coil preferably is a combination of a primary coil element and a secondary coil element that are wound around a common core. Desirably, the secondary coil element is connected to the spark plugs, while the primary coil element is connected to the igniter. Also, the primary coil element is coupled with a power source so that electrical current flows therefthrough. The igniter abruptly cuts off the current flow in response to an ignition timing control signal from the ECU and then a high voltage current flow occurs in the secondary coil element. The high voltage current flow forms a spark at each spark plug.

In the illustrated engine 58, the pistons 86 reciprocate between top dead center and bottom dead center. When the crankshaft 92 makes two rotations, the pistons generally move from top dead center to bottom dead center (the intake stroke), from bottom dead center to top dead center (the compression stroke), from top dead center to bottom dead center (the power stroke) and from bottom dead center to top dead center (the exhaust stroke). During the four strokes of the pistons 86, the camshafts 104 make one rotation and actuate the intake and exhaust valves to open the intake ports during the intake stroke and to open exhaust ports during the exhaust stroke, respectively.

Generally, at the beginning of the intake stroke, air preferably is drawn through the air intake passages and fuel preferably is injected into the intake passage by the fuel injectors. The air and the fuel thus are mixed to form the air/fuel charge in the combustion chambers. Near the beginning of a power stroke, the respective spark plugs ignite the compressed air/fuel charge in the respective combustion chambers. The air/fuel charge thus rapidly burns and expands during the power stroke, thereby moving the pistons. The burnt charge, i.e., exhaust gases, then are discharged from the combustion chambers 88 during an exhaust stroke following the power stroke. The intake and exhaust valves are actuated between the open and closed positions by the camshafts 104 that are driven by the crankshaft 100 via the timing belt 110. The engine 58 continuously repeats the foregoing four strokes during its operation.

During the engine operation, heat from combustion is transferred to the engine body 96, the exhaust manifold and other various peripheral engine components disposed around the engine body 96. The outboard motor 30 thus includes a water cooling system and preferably employs an open-loop type water cooling system 112. The cooling system 112 draws cooling water, as coolant, from a body of water surrounding the motor 30 and circulates the water into thermal communication with several components of the outboard motor 30. The system 112 then returns the water to the body of water. One purpose for the employment of the cooling system 112 is to help cool the engine body 96, the exhaust manifold and the engine components.

In the illustrated arrangement, the engine body 96 has one or more water jackets through which water travels to remove the heat from the engine body 96, the exhaust manifold and the engine components. A water introduction device, delivery passages and discharge passages can be defined within the housing unit 52. Preferably, the water cooling system 112 further cools part of the exhaust system 100 disposed within the housing unit 52. The cooling system 112 will be described in greater detail later with further reference to the remaining figures.

The engine 58 preferably includes a lubrication system. Although any type of lubrication systems can be applied, a closed-loop type of system is employed in the illustrated embodiment. The lubrication system comprises a lubricant reservoir (or lubricant tank) member 114 preferably positioned within the driveshaft housing 54. The illustrated lubricant reservoir member 114 is disposed at an upper position of the driveshaft housing 54 below the exhaust guide member 78. In some applications, however, the lubricant reservoir member 114 is not necessarily positioned within the housing unit 52 such that a lubricant holding tank is integrally formed with the crank chamber. In another arrangement, the reservoir member 114 is positioned on the watercraft 40 rather than on the outboard motor 30.

In the illustrated arrangement, an oil pump 122 can be provided at a desired location, such as a lowermost portion of the camshaft 104, to pressurize the lubricant oil in the reservoir member 114 and to pass the lubricant oil through a suction pipe toward engine portions, which are desirably lubricated, through lubricant delivery passages. Preferably, lubricant oil is guided to the crankshaft bearings, the connecting rods 94 and the pistons 86. Lubricant return passages also are provided to return the oil to the lubricant reservoir member 114 for re-circulation.

Preferably, the lubrication system further comprises a filter assembly to remove foreign matter (e.g., metal shavings, dirt, dust and water) from the lubricant oil before the oil is re-circulated or delivered to the various engine portions. The cylinder head assembly 88 has a lubricant supply inlet 124 that communicates with the lubricant reservoir member 114, while the lubricant reservoir member 114 has a drain 126 at a rear bottom portion thereof. A plug 128 closes the drain 126. A structure of the lubricant reservoir member 114 is described below in greater detail with further reference to some of the remaining figures.

A flywheel assembly 130 preferably is positioned at a top of the crankshaft 92 and is mounted for rotation with the crankshaft 92. The illustrated flywheel assembly 130 comprises a flywheel magneto or AC generator that supplies electric power to various electrical components such as the fuel injection system, the ignition system and the ECU.

The driveshaft housing 54 is positioned below the exhaust guide member 78. A driveshaft 134 extends generally vertically through the driveshaft housing 54. The driveshaft 134 is journalled for rotation in the driveshaft housing 62 and is driven by the crankshaft 92. The driveshaft housing 54 also supports an exhaust conduit or pipe 136, which forms a portion of the exhaust system 100.

Preferably, the exhaust conduit 136 is generally formed as a cylindrical configuration to define an inner exhaust passage 137. An idle discharge section is further defined in the driveshaft housing 54. The idle discharge section includes an idle expansion chamber 138 and an idle discharge port 140. An apron 142 covers an upper portion of the driveshaft housing 54 and improves the overall appearance of the outboard motor 30. The apron 142 has openings through which at least the exhaust discharge port 140 and the oil drain 120 communicate with the exterior of the apron 142.

The lower unit 56 depends from the driveshaft housing 54 and supports a propulsion shaft 144, which is driven by the driveshaft 134. The propulsion shaft 144 extends generally horizontally through the lower unit 56. A propulsion device is attached to the propulsion shaft 144 and is powered through the propulsion shaft 144. In the illustrated arrangement, the propulsion device is a propeller 146 that is affixed to an outer end of the propulsion shaft 144. The propulsion device, however, can take the form of a dual counter-rotating system, a hydrodynamic jet, or any of a number of other suitable propulsion devices.

A transmission 148 preferably is provided between the driveshaft 134 and the propulsion shaft 144. The transmission 148 couples together the two shafts 134, 144 which lie generally normal to each other (i.e., at a 90° shaft angle) with bevel gears. The outboard motor 30 has a switchover or clutch mechanism that allows the transmission 148 to change the rotational direction of the propeller 146 among forward, neutral or reverse.

The lower unit 56 also defines an internal passage of the exhaust system 100. An expansion chamber 150 occupies major volume of the passage and is formed above a space where the propulsion shaft 144 extends so that the exhaust conduit 136 communicates with the expansion chamber 150. At engine speeds above idle, the exhaust gases generally are discharged to the body of water surrounding the outboard motor 30 through the internal passage and finally through a discharge section defined within the hub of the propeller 146. The foregoing idle discharge section is provided for lower speed engine operation. The difference in the locations of the discharges accounts for the differences in pressure at locations above the waterline and below the waterline. Because the opening above the waterline is smaller, pressure develops within the lower unit 56. When the pressure exceeds the higher pressure found below the waterline, the exhaust gases exit through the hub of the propeller 144. If the pressure remains below the pressure found below the waterline, the exhaust gases exit through the idle discharge section including the discharge port 140 above the waterline.

With continued reference to FIGS. 1 and 2 and additional reference to FIGS. 3–6, the exhaust system 100, the water cooling system 112, the lubricant reservoir member 114 and mutual relationships among them are described in greater detail below.

The exhaust guide member 78 preferably defines a coupling boss 160 through which the exhaust passage 80 extends generally vertically, while the lubricant reservoir member 114 preferably defines another coupling boss 162 at a center portion of the reservoir member 114. The coupling boss 162 of the lubricant reservoir member 114 defines an exhaust path 164 that is configured as a square shape atop thereof and also as a round shape at the bottom thereof.

Figure 3:
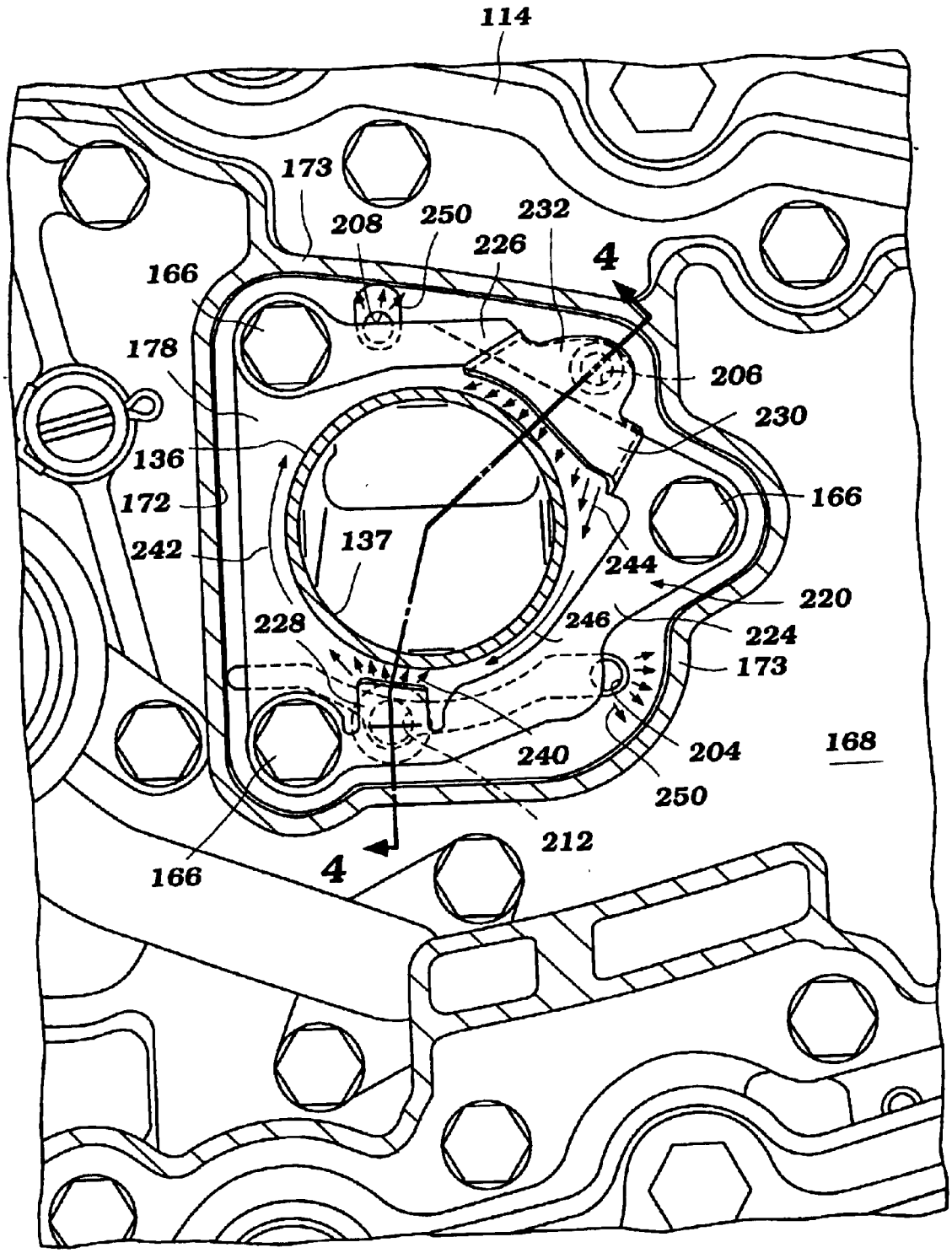
FIG. 3 is a bottom plan view of the driveshaft housing taken along the line 3—3 of FIG. 2.

The coupling bosses 162, 166 are mated with each other and are coupled together by three bolts 166 which are generally placed at apexes of a triangle that surrounds the exhaust path 164 as shown in FIG. 3. Thereby, a bottom end of the exhaust guide member 78 and a top end of the lubricant reservoir member 114 together define an annular reservoir cavity 168 where lubricant oil is collected and together connect the exhaust path 164 with the exhaust passage 80. A gasket can be interposed between the bottom end of the exhaust guide member 78 and the top end of the lubricant reservoir member 114. The exhaust guide member 78 coupled together with the lubricant reservoir member 114 defines an intermediate unit 170.

The reservoir member 114 further forms a recessed portion 172 below the coupling boss 162 with a vertical annular wall 173. The recessed portion 172 opens downward so that the reservoir member 114 defines a reversed cup-like shape. However, the coupling bosses 160, 162 do not necessarily close the upper end of the recessed portion 172. Rather, the recessed portion 172 can be a through-hole. In this alternative, the lubricant reservoir member 114 is affixed to the exhaust guide member 78 at other portions such as, for example, peripheral edges of the reservoir member 114.

The exhaust conduit 136 in the illustrated arrangement depends from the coupling boss 162 of the lubricant reservoir member 114 with its top end resting atop the recessed portion 172. If the coupling portion 162 is not provided as in the alternative, the exhaust conduit 136 directly depends from the exhaust guide member 78. The exhaust conduit 136 extends downward through and beyond the recessed portion 172. Because an inner diameter of the recessed portion 172 is greater than an outer diameter of the exhaust conduit 136, a space 174 is defined between the exhaust conduit 136 and the lubricant reservoir member 114. The exhaust conduit 136 preferably is made of stainless steel and is treated by electrical isolation treatment and/or a corrosion-proof treatment.

Figure 4:
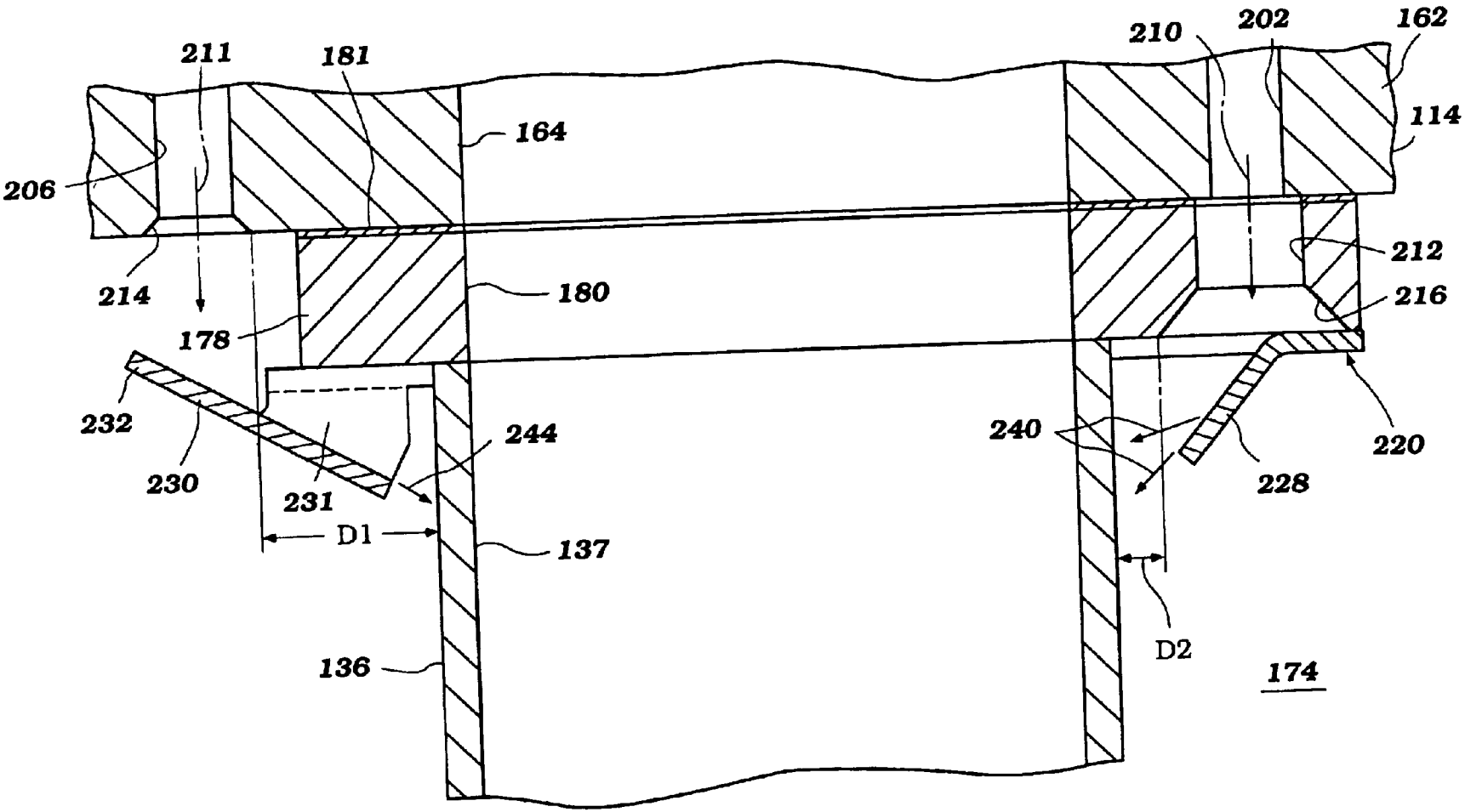
FIG. 4 is an enlarged sectional view taken along the line 4—4 of FIG. 3.

A flange member 178 is welded to a top end of the exhaust conduit 136. The flange member 178 is generally configured as a triangle that defines a round-shaped opening 180 at its center portion and three apexes generally corresponding to the apexes of the coupling boss 162 of the reservoir member 114. The flange member 178 is affixed to the bottom of the coupling boss 162 so that the exhaust conduit 136 extends downward. In this embodiment, the coupling boss 162 is a spacer with which the exhaust conduit 136 depends from the exhaust guide member 78. Because the flange member 178 has the round-shaped opening 180, the inner passage 137 of the exhaust conduit 136 communicates with the exhaust path 164 of the coupling boss 162 through the round-shaped opening 180. As shown in FIG. 4, a gasket 181 preferably is interposed between the flange member 178 and the coupling boss 162 to inhibit the exhaust gases from leaking. The gasket 181 of course forms an opening that has the same shape and size as the opening 180 of the flange member 178.

With reference to FIGS. 1–6, the exhaust guide member 78 also defines a water collection area CW (FIG. 1) that communicates with a water delivery area DW defined next to the exhaust manifold in a bottom of the cylinder block 82. The coolant water is delivered to the water jackets of the engine body 96 through the collection area CW and the delivery area DW. A water inlet port 188 is defined in the lower unit 56 at a location submerged when the drive unit 34 is tilted down. A water inlet passage 190, which is also defined in the lower unit 56, and a water supply pipe 192 extending vertically through the driveshaft housing 54 together connect the inlet port 188 to the collection area CW in the exhaust guide member 78. A water pump 194 is disposed at a bottom portion of the driveshaft housing 54 to couple the inlet passage 190 with the supply pipe 192 and to pressurize water for delivery to the collection area CW. The water pump 194 preferably is driven by the driveshaft 134.

The exhaust conduit 136 preferably extends down to almost a bottom end of the driveshaft housing 54 to be connected to the expansion chamber 150 of the lower unit 56. The driveshaft housing 54 has several internal walls 182 extending upwardly from the bottom end of the driveshaft housing 54 to doubly surround the exhaust conduit 136. The internal walls 182 preferably define dual water pools 184, i.e., an inner water pool and an outer water pool, that are generally configured as relatively deep vessels to accumulate water therein. One or more seal members 185 are interposed between the exhaust conduit 136 and the internal walls 182 to prevent the water in the vessels from leaking to the expansion chamber 150. The exhaust conduit 136 extends downward beyond a bottom end of the water pools 184.

The outer pool is provided with fresh and colder water from the water collection area CW, while the inner pool is provided with warmer water that has traveled around water jackets of the engine body 96. Thus, the water in the inner pool directly cools the exhaust conduit 136 and the water in the outer pool cools the water in the inner pool.

One of the internal walls 182 defines a weir 186 to form a spillway that communicates with a water discharge passage 188 through a discharge port 190 and a discharge pipe 192 connected with the discharge port 190. Several slots 194 are formed at a bottom portion of the discharge passage 188 in the lower unit 56. The water accumulating within the inner pool spills over from the weir 186 to flow down through the discharge passage 188 and is discharged to a location out of the outboard motor 30 through the slots 194. Because the weir 186 is formed below the bottom end of the lubricant reservoir member 114 and regulates a water level 196 (FIG. 2) of the inner pool, the space 174 defined between the exhaust conduit 136 and the lubricant reservoir member 114 is never filled with the water in the inner pool.

Another weir (not shown) that is positioned higher than the weir 186 regulates a water level 198 (FIG. 2) of the outer pool. The lubricant reservoir member 114 thus is surrounded by the water of the outer pool about halfway and is cooled by the water accordingly. The water spilling over the weir from the outer pool can enter the inner pool. Both the internal walls 182 defining the water pools 184 have at least one small aperture at the bottom thereof. Thus, with the engine operation stopped, the water in the water pools 184 can move to the discharge slots 194 and be discharged therethrough.

Figure 5:
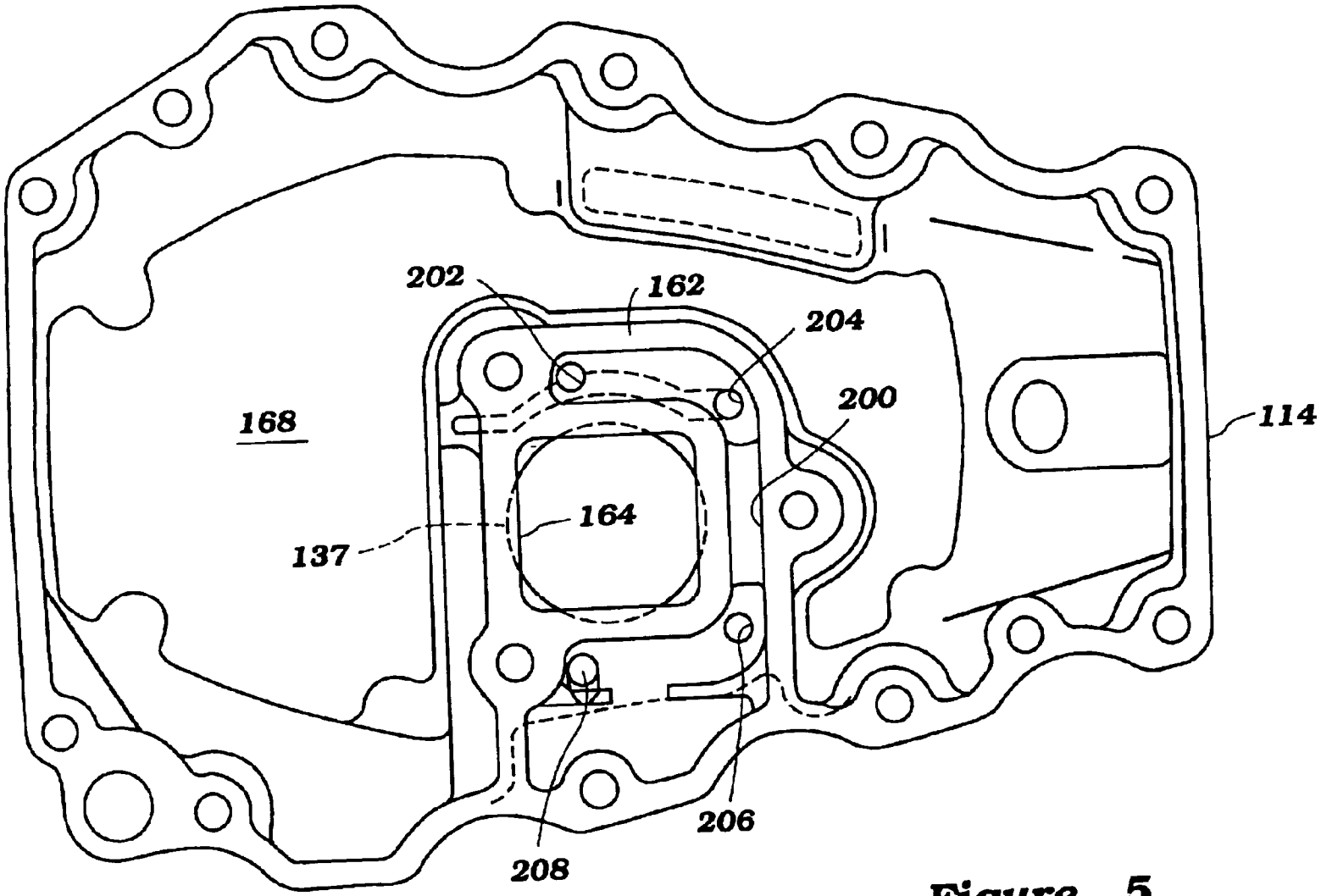
FIG. 5 is a top plan view of a lubricant reservoir.

The water that has traveled around the water jackets of the engine body 96 falls to a drain 200 (FIGS. 2 and 5) which is defined by cooperating grooves formed on the top surface of the coupling boss 162 and on the bottom surface of the exhaust guide member 78 as shown in FIG. 2. The drain 200 is shaped as the letter C and lies to partially surround the exhaust path 164 as shown in FIG. 5.

In order to cool the exhaust conduit 136 and the reservoir member 114, the water in the drain 200 moves down to the space 174 defined within the recessed portion 172 through four water passages 202, 204, 206, 208 as indicated with arrows 210, 211 of FIG. 4. Two of the passages 202, 204 are formed generally between two of the bolts 166 on the port side, while the other two of the passages 206, 208 are formed generally between two of the bolts 166 on the starboard side.

Figure 6:
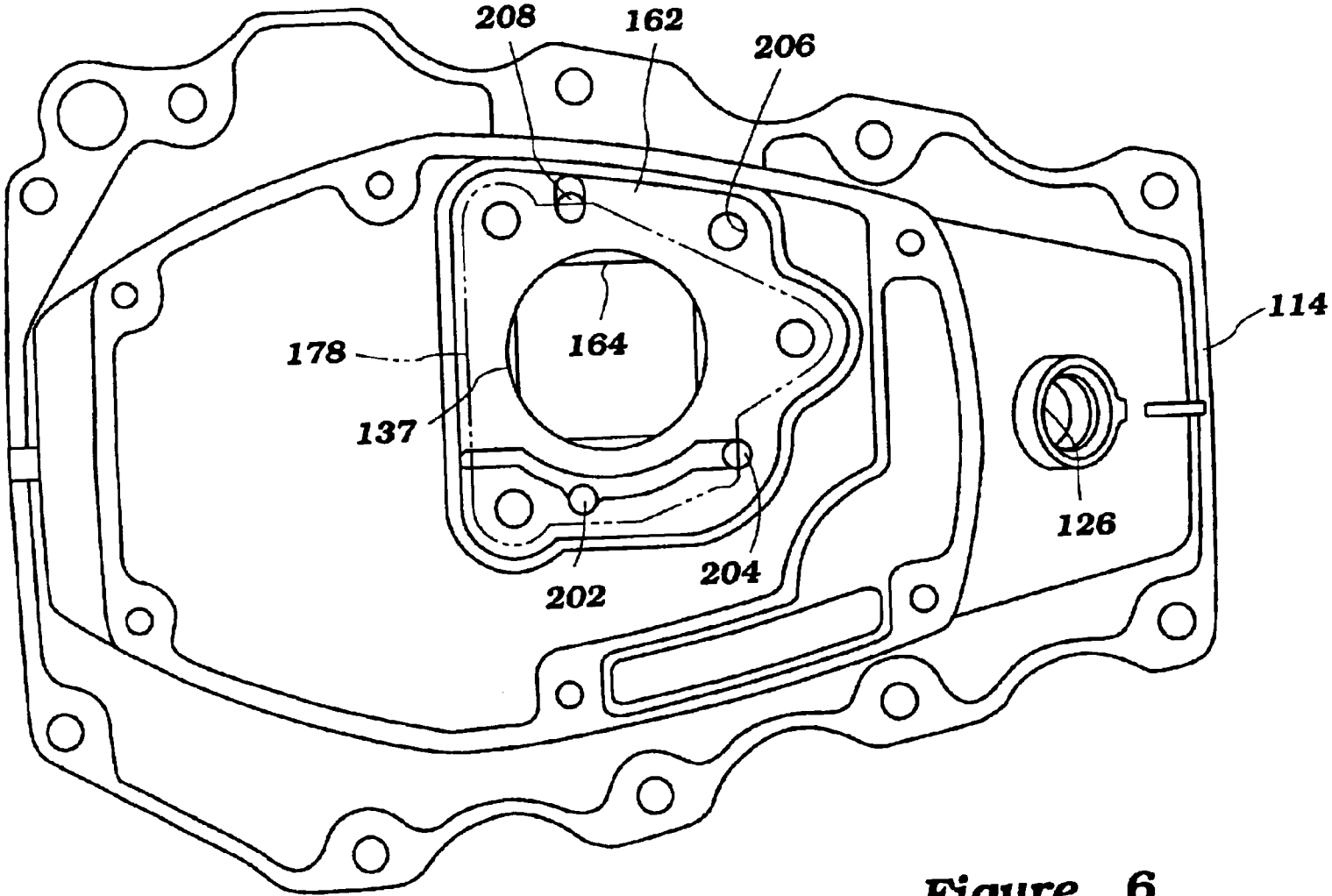
FIG. 6 is a bottom plan view of the lubricant reservoir shown in FIG. 5.

With reference to FIG. 4, one of the passages 202 opens to the space 174 through a water passage 212 formed in the flange member 178. The passages 204, 206, 208 have discharge ports 214 that are gradually widened in a downward direction. The passage 212, has a discharge port 216 that is gradually widened downward. The flange member 178 overlaps and thus closes approximately half of the discharge ports 214 of the water passages 204,208 as shown in FIGS. 3 and 6.

With reference to FIG. 4, the discharge ports 214, 216 are spaced apart from the outer surface of the exhaust conduit 136. For example, the discharge port 214 of the passage 206 is positioned at a location spaced with a distance D1. Even the discharge port 216 of the passage 216, which is closer than the discharge port 214, is positioned at a location spaced with a distance D2. Although the gradually widened shape of the discharge ports 214, 216 can direct some part of the water toward the exhaust conduit 136 to a certain extent, a major part of the water goes straight down to the inner water pool 184. A water guide member 220 thus is provided in this illustrated arrangement to direct the water discharged through the discharge ports 214, 216 toward the outer surface of the exhaust conduit 136.

Figure 8:
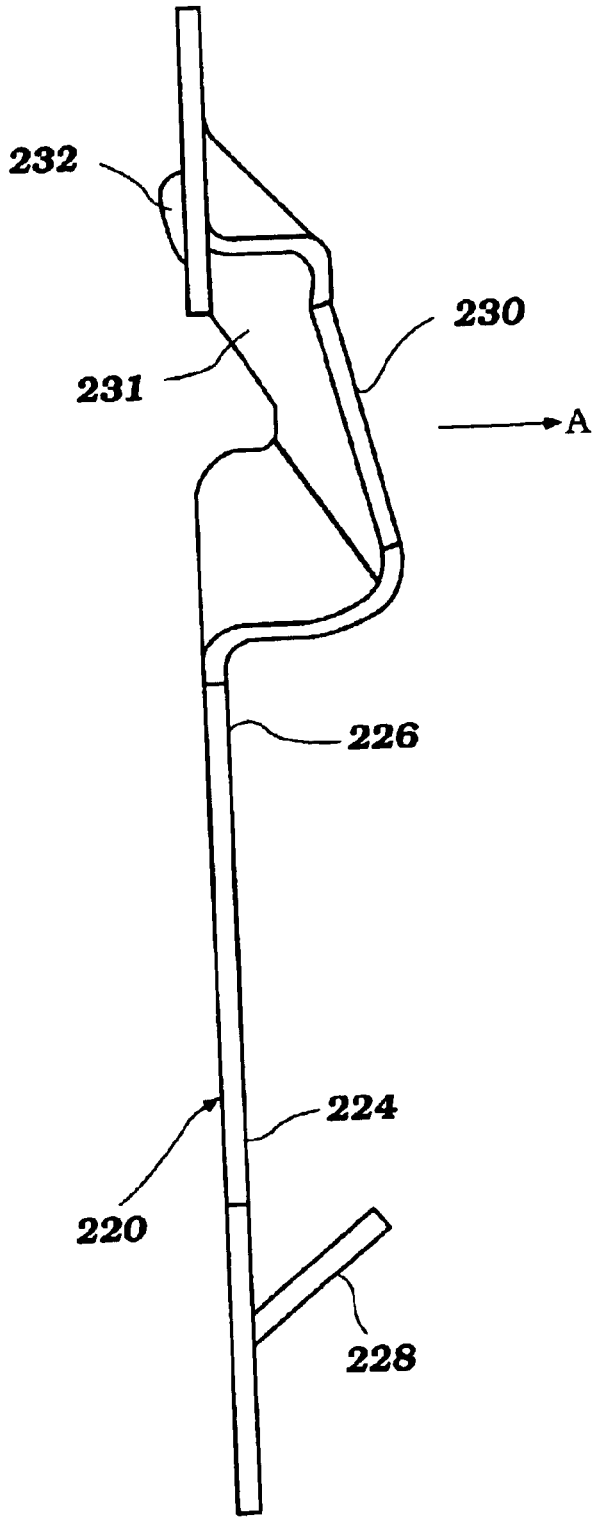
FIG. 8 is a side elevational view of the guide member as viewed from the direction of the arrow 8.
Figure 9:
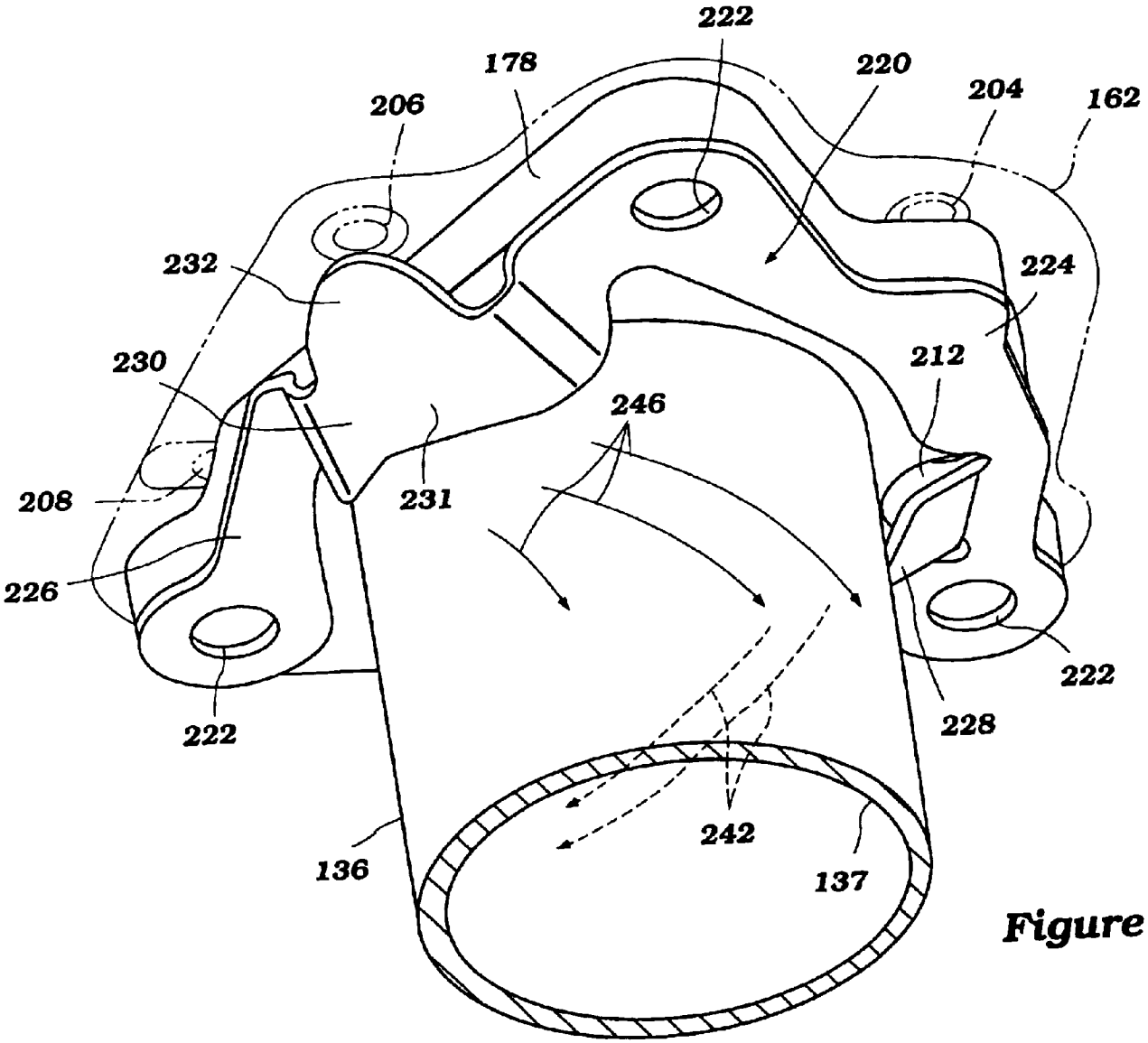
FIG. 9 is a perspective view showing the guide member attached to an exhaust conduit.

With continued reference to FIGS. 2–6 and additional reference to FIGS. 7–9, the guide member 220 and constructions around the guide member 220 is described in greater detail below.

Figure 7:
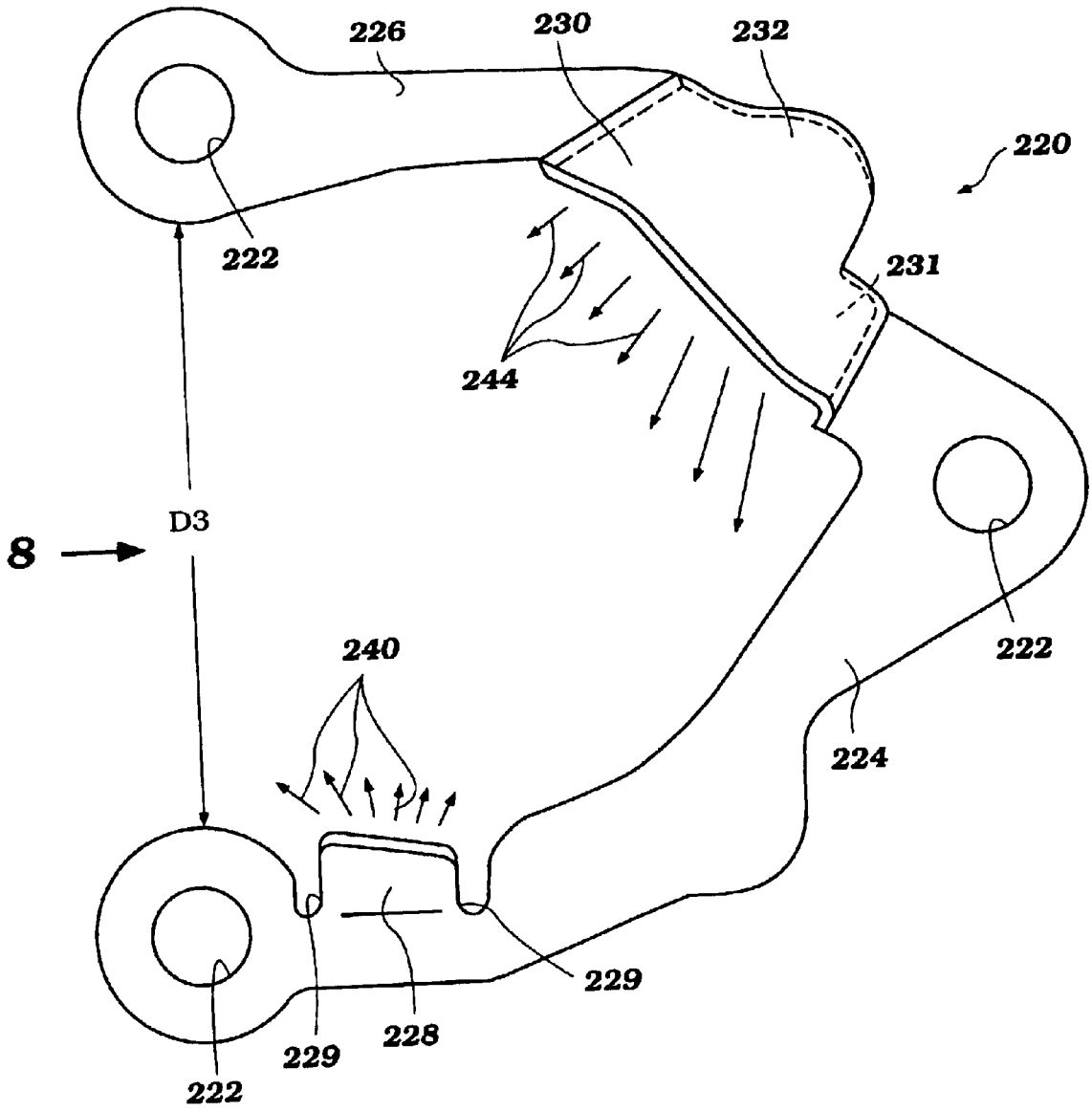
FIG. 7 is a bottom plan view of an exemplary guide member.

As shown in FIG. 7, the illustrated guide member 220 is formed with a single piece, although it can be formed with two or more pieces. The guide member 220 preferably is shaped generally as a fork, as the letter C, or a triangle which lacks one side thereof. A bolt hole 222, which defines a fixing section in this arrangement, is formed at each apex of the triangle.

Two sides 224, 226 connect the bolt holes 222 with each other. A distance D3 between the ends of the two sides 224, 226 is longer than an outer diameter of the exhaust conduit 136. The sides 224, 226 define bridge sections. A first guide section 228 is formed in the bridge section 224 and thus is positioned between two bolt holes 222. The first guide section 228 includes a projection that is slightly bent in a thickness direction of the member 220. The bend is directed downward when the guide member 220 is mounted on the flange member 178 as shown in FIG. 4.

A second guide section 230 also is formed in the bridge section 226 and is positioned between two bolt holes 222. The respective guide sections 228, 230 are disposed generally oppositely relative to each other. The second guide section 230 includes a hollow 231. The hollow 231 is slanted in two directions. One of the directions is the same as the bend direction of the projection of the first guide section 228. The other direction is indicated by the arrow A of FIG. 8. That is, in the mounted position, the hollow 231 gradually increases its height rearwardly. In addition, the second guide section 230 further includes a projection 232 that extends generally outwardly from the triangle.

The guide member 220 preferably is made of a steel sheet. Each edge of the material of the member 220 can be formed, for example, in a punching process. The bolt holes 222 also are made in the punching process, preferably simultaneously. The projection of the first guide section 228 can be bent in a press process. Notches 229 (FIG. 7) are helpful in bending of the projection. The hollow 231 of the second guide section 230 also can be in the same press process, although a separate press process is practicable.

The guide member 220 is mounted on the bottom of the flange member 178 to surround the exhaust conduit 136. Because the distance D3 between the ends of the two sides 224, 226 of the member 220 is longer than the outer diameter of the exhaust conduit 136, the member 220 can be inserted from the rear side of the housing unit 52 even though the exhaust conduit 136 is placed in the normal position.

The illustrated guide member 220 is affixed to the flange member 178 by the three bolts 166. That is, the coupling boss 162 of the reservoir member 114, the flange member 178 of the exhaust conduit 136 and the guide member 220 altogether are affixed to the bottom of the exhaust guide member 78 by the bolts 166. In the fixed position, the projection of the first guide section 228 is located below the discharge port 212 of the flange member 178 and the projection 232 of the second guide section 230 is located below the discharge port 206 of the coupling boss 162, as best shown in FIG. 3.

The projection of the first guide section 228 is slanted downward and is directed to the outer surface of the exhaust conduit 136 as shown in FIG. 4. Preferably, the projection of the first guide section 228 does not normally face to the exhaust conduit 136 but faces slightly tangentially thereto so that water can swirl down around the outer surface of the exhaust conduit 136. Such as tangential orientation further enhances the cooling improvement provided by the guide member 220.

The hollow 231 of the second guide section 230 also is slanted downward and is directed to the outer surface of the exhaust conduit 136 as best shown in FIG. 4. Preferably, the hollow 231 of the first guide section 228 does not normally face to the exhaust conduit 136 but faces slightly tangentially thereto so that water can swirl down around the outer surface of the exhaust conduit 136. The direction of the swirl preferably is the same as the direction of the swirl made by the projection of the first guide section 228. As such, the two swirling flows provide further enhanced cooling. Additionally, the flows more evenly cool the exhaust conduit 136, and thereby reduce the severity of thermal gradients around the conduit 136, and thus reduce thermal stresses and fatigue.

In the fixed position of the guide member 220, the bridge sections 224, 226 close the discharge ports 214 of the water passages 204, 208 together with the flange member 178 as shown in FIG. 3.

The water falling down through the water passages 202, 212 as indicated by the arrow 210 of FIG. 4 impinges upon the projection of the first guide member 228. The projection alters the direction of the water toward the exhaust conduit 136 as indicated by the arrows 240 of FIGS. 3, 4 and 7 so that major part of the water swirls down around the outer surface of the exhaust conduit 136 as indicated by the arrows 242 of FIGS. 3 and 9. The water falling down through the water passage 206 as indicated by the arrow 211 of FIG. 4 impinges upon the projection 232 of the second guide member 230 and moves to the hollow 231 thereof. The projection 232 and the hollow 231 alter the direction of the water toward the exhaust conduit 136 as indicated by the arrows 244 of FIGS. 3, 4 and 7 so that major part of the water swirls down around the outer surface of the exhaust conduit 136 as indicated by the arrows 246 of FIGS. 3 and 9. The swirls 242, 246 of the water flow are made in the same direction, i.e., clockwise as shown in FIG. 3. Making the swirls 242, 246 is quite advantageous because almost all areas of the outer surface of the exhaust conduit 136 can be covered with the water flow despite only two discharge ports are used for the purpose. The exhaust conduit 136 thus is greatly cooled down.

In the illustrated arrangement, the discharge ports of the water passages 204, 208 are closed generally halfway by the flange member 178 together with the guide member 220 as described above. Because of this arrangement, the water coming down through the water passages 204, 208 are directed toward the vertical wall 173 of the reservoir member 114 that surrounds the exhaust conduit 136 as indicated by arrows 250 of FIG. 3. The vertical wall 173 of the reservoir member 114 can also be cooled accordingly.

It is to be noted that the guide member 220 can still be oriented so as to partially cover the discharge ports of the water passages 204, 208 without the presence of the flange member 178.

Figure 10:
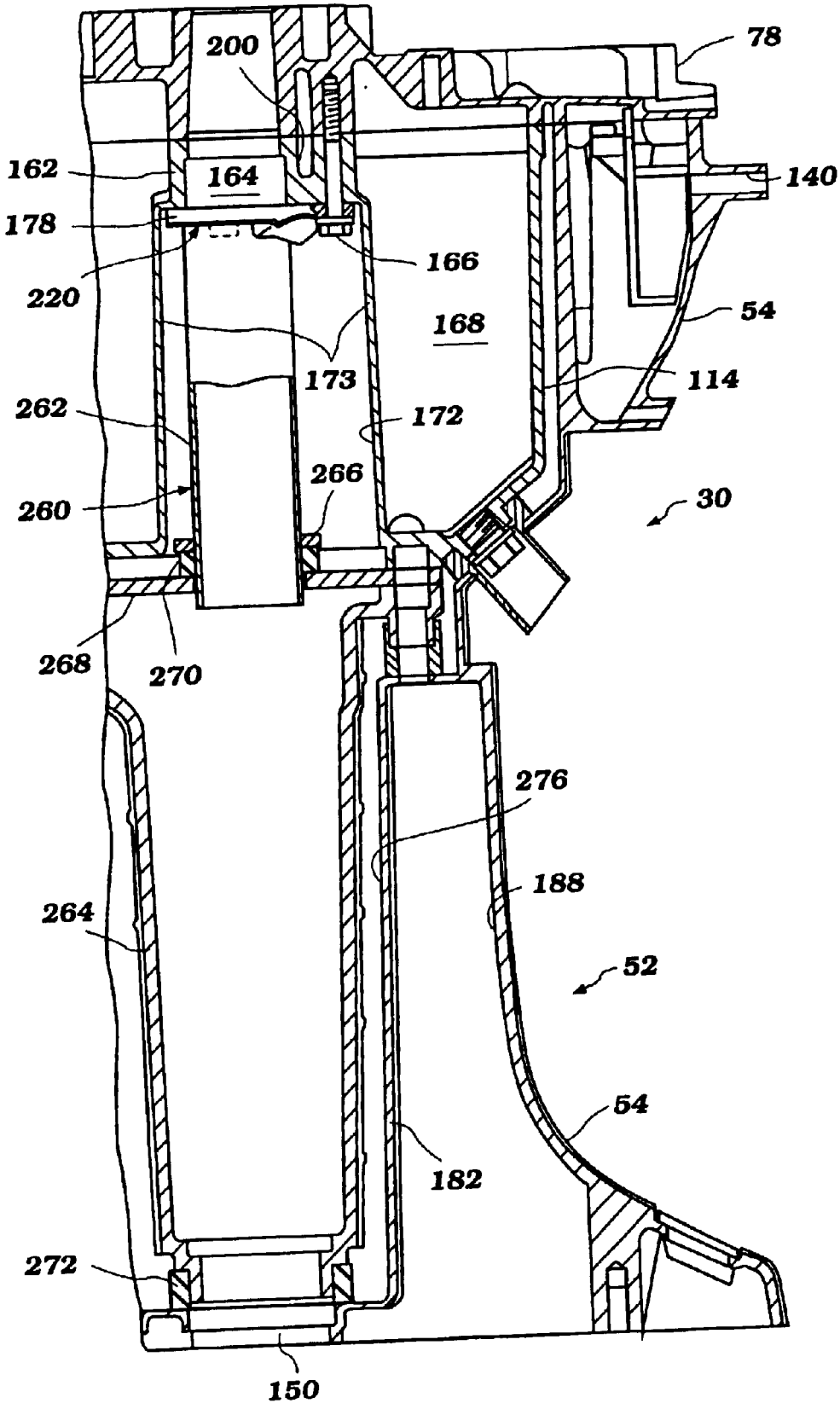
FIG. 10 is a partial side elevational, sectional view of a modification of the driveshaft housing shown in FIG. 2.

FIG. 10 illustrates an alternative driveshaft housing in which another exhaust conduit construction is applied but the same guide member is employed. The same members, components and systems that have been described above will be assigned with the same reference numerals and will not be described repeatedly.

The driveshaft housing 54 in this arrangement comprises an exhaust conduit unit 260 comprising an upper exhaust conduit 262 and a lower exhaust conduit 264. The upper exhaust conduit 262 is similar to the exhaust conduit 136 in the first arrangement but is formed shorter than the exhaust conduit 136. The upper exhaust conduit 260 is affixed to the coupling boss 162 of the reservoir member 114 with the flange member 178 by bolts 166. The guide member 220, which is the same as that in the first arrangement, also is affixed onto the flange member 178. The upper exhaust conduit 262 is provided with a lower flange member 266 welded around a lower portion of the exhaust conduit 262. The driveshaft housing 54 includes a support plate 268 extending generally horizontally and defining an opening. A bottom end of the upper exhaust conduit 262 extends through the opening so that the lower flange member 266 is supported by the support plate 268 via a seal member 270.

The lower exhaust conduit 264 extends under the opening of the support plate 268 and is rested at a step portion of the internal wall 182 via a seal member 272. Because the lower exhaust conduit 264 has a volume that is greater than a volume of the upper exhaust conduit 262, the lower exhaust conduit 264 can act as an expansion chamber.

A water pool 276 like the water pools 184 in the first arrangement surrounds the lower exhaust conduit 264 so as to cool the lower conduit 264. The water in the water pool 276 moves to the discharge passage 188 through a path or weir that is not shown. Also, the water that has traveled around the water jackets of the engine body moves to the discharge passage 188 through the drain 200, the recessed portion 172 and one or more passages that are not shown. The water in the discharge passage 188 is discharged outside location of the outboard motor 30 through the slots 194 formed in the lower unit 56.

Of course, the foregoing description is that of a preferred construction having certain features, aspects and advantages in accordance with the present invention. Various changes and modifications may be made to the above-described arrangements without departing from the spirit and scope of the invention, as defined by the appended claims.

What is claimed is:

1. An outboard motor comprising a housing unit adapted to be mounted on an associated watercraft, an internal combustion engine having at least one exhaust port, an engine support supporting the engine above the housing unit, an exhaust system configured to guide exhaust gasses from the exhaust port, the exhaust system comprising an exhaust manifold communicating with the exhaust port and an exhaust conduit having an upper end communicating with the exhaust manifold and extending downwardly into the housing, a cooling system configured to guide coolant into thermal communication with at least a portion of the exhaust system, the cooling system comprising a coolant conduit extending along a first direction generally parallel to the exhaust conduit and terminating at a first discharge opening disposed adjacent to the exhaust conduit, and a guide member disposed adjacent to the first discharge opening, the guide member having a surface at least partially overlapping the first discharge opening and skewed relative to the first direction such that coolant discharged from the first discharge opening is diverted by the surface toward the exhaust conduit.

2. The outboard motor as set forth in claim 1, wherein the guide member is coupled with the engine support.

3. The outboard motor as set forth in claim 2, wherein the exhaust conduit forms a flange portion, and the guide member is affixed to the engine support along with the flange portion.

4. The outboard motor as set forth in claim 3, wherein the flange portion defines a portion of the coolant passage, and the portion of the coolant passage defines the first discharge opening.

5. The outboard motor as set forth in claim 2, wherein the guide member generally surrounds the exhaust conduit, the guide member forms at least two guide sections and at least one fixing section, the fixing section being interposed between the guide sections.

6. The outboard motor as set forth in claim 5, wherein the guide member additionally comprises bridge sections connecting the guide sections with the fixing section.

7. The outboard motor as set forth in claim 2, additionally comprising a second discharge opening disposed adjacent to the exhaust conduit, the guide member closing generally half of the second discharge opening so that the coolant discharged from the second discharge opening is directed at a side of the exhaust conduit opposite from the first discharge opening.

8. The outboard motor as set forth in claim 1 additionally comprising an exhaust guide member, the engine support and the exhaust guide member defining an intermediate unit.

9. The outboard motor as set forth in claim 8, wherein the exhaust guide member is coupled with the engine support.

10. The outboard motor as set forth in claim 8, wherein the exhaust guide member at least partially defines a lubricant reservoir to contain engine lubricant therein, the lubricant reservoir surrounding at least a top portion of the exhaust conduit.

11. The outboard motor as set forth in claim 1, wherein an outer surface of the exhaust conduit is configured as a cylindrical shape, the guide member being configured such that coolant diverted from the guide member swirls down along the outer surface of the exhaust conduit.

12. The outboard motor as set forth in claim 1, wherein the guide member generally surrounds the exhaust conduit and defines at least two guide sections.

13. The outboard motor as set forth in claim 12, wherein the respective guide sections are disposed on opposite sides of the exhaust conduit.

14. The outboard motor as set forth in claim 13, wherein an outer surface of the exhaust conduit is configured as a cylindrical shape, the guide sections being directed to the outer surface of the exhaust conduit so that the coolant diverted by each one of the guide sections swirls down along the outer surface of the exhaust conduit in generally the same direction as one another.

15. The outboard motor as set forth in claim 1, wherein the guide member is configured as a fork shape having two ends, a distance between the two ends is greater than an outer diameter of the exhaust conduit, the guide member being affixed to the intermediate unit to generally surround the exhaust conduit.

16. The outboard motor as set forth in claim 1, wherein the engine defines a coolant jacket, and the coolant passage is connected to the coolant jacket.

17. An outboard motor comprising a housing unit adapted to be mounted on an associated watercraft, an internal combustion engine, a support member coupled with the housing unit to support the engine above the housing unit, an exhaust conduit arranged to discharge exhaust gases from the engine, a spacer coupled with the support member to carry the exhaust conduit under the engine so that the exhaust conduit extends generally vertically within the housing unit, at least the spacer defining a coolant passage having a discharge port spaced apart from an outer surface of the exhaust conduit, and a guide spaced below the port and configured to direct coolant discharged from the discharge port toward the outer surface of the exhaust conduit.

18. An outboard motor comprising a housing unit adapted to be mounted on an associated watercraft, an internal combustion engine, a support member coupled with the housing unit to support the engine above the housing unit, an exhaust conduit arranged to discharge exhaust asses from the engine, a spacer coupled with the support member to carry the exhaust conduit under the engine so that the exhaust conduit extends generally vertically within the housing unit, at least the spacer defining a coolant passage having a discharge port spaced apart from an outer surface of the exhaust conduit, and a guide configured to direct coolant discharged from the discharge port toward the outer surface of the exhaust conduit, wherein the guide is mounted on the spacer.

19. The outboard motor as set forth in as set forth in claim 18, wherein the outer surface of the exhaust conduit is configured as a cylindrical shape, the guide being formed so that the coolant coming from the guide swirls down along the outer surface of the exhaust conduit.

20. An outboard motor comprising a housing unit adapted to be mounted on an associated watercraft, an internal combustion engine, a support member coupled with the housing unit to support the engine above the housing unit, an exhaust conduit arranged to discharge exhaust eases from the engine, a spacer coupled with the support member to carry the exhaust conduit under the engine so that the exhaust conduit extends generally vertically within the housing unit, at least the spacer defining a coolant passage having a discharge port spaced apart from an outer surface of the exhaust conduit, and a guide configured to direct coolant discharged from the discharge port toward the outer surface of the exhaust conduit, wherein the guide comprises at least one guide member configured as a fork shape having two ends, a distance between the two ends being greater than an outer diameter of the exhaust conduit, the guide being affixed to the intermediate unit to generally surround the exhaust conduit.

21. An outboard motor comprising an internal combustion engine, a housing unit disposed below the engine, an exhaust conduit arranged to discharge exhaust gases from the engine, the exhaust conduit extending generally vertically within the housing unit, and a cooling system arranged to cool the exhaust conduit with coolant, the cooling system including a coolant passage generally disposed higher than the exhaust conduit, the coolant passage defining a discharge port spaced apart from an outer surface of the exhaust conduit, and means for guiding the coolant discharged from the discharge port so that the coolant swirls down around the exhaust conduit.

22. The outboard motor as set forth in claim 21, wherein the engine forms a coolant jacket, and the coolant passage is connected to the coolant jacket.

* * * * *

UNITED STATES PATENT AND TRADEMARK OFFICE

CERTIFICATE OF CORRECTION

PATENT NO. : 6,893,306 B2
APPLICATION NO. : 10/106525
DATED : May 17, 2005
INVENTOR(S) : Yasuhiko Shibata et al.

It is certified that error appears in the above-identified patent and that said Letters Patent is hereby corrected as shown below:

At column 6, line 32, please delete “therefthrough.” and insert -- therethrough. --, therefor.

At column 15, line 25, in Claim 18, please delete “asses” and insert -- gases --, therefor.

At column 16, line 7, in Claim 20, please delete “eases” and insert -- gases --, therefor.

Signed and Sealed this

Sixth Day of May, 2008

JON W. DUDAS
*Director of the United States Patent and Trademark Office*